US011754074B2

(12) United States Patent
Bonnefoi

(10) Patent No.: US 11,754,074 B2
(45) Date of Patent: Sep. 12, 2023

(54) SCROLL COMPRESSOR HAVING A CENTRIFUGAL OIL PUMP

(71) Applicant: Danfoss Commercial Compressors, Trevoux (FR)

(72) Inventor: Patrice Bonnefoi, Nordborg (DK)

(73) Assignee: Danfoss Commercial Compressors, Trevoux (FR)

( * ) Notice: Subject to any disclaimer, the term of this patent is extended or adjusted under 35 U.S.C. 154(b) by 0 days.

(21) Appl. No.: 17/690,517

(22) Filed: Mar. 9, 2022

(65) Prior Publication Data

US 2022/0290671 A1 Sep. 15, 2022

(30) Foreign Application Priority Data

Mar. 10, 2021 (FR) ..... 2102350

(51) Int. Cl.
*F04C 29/02* (2006.01)
*F04C 18/02* (2006.01)
*F04C 23/00* (2006.01)

(52) U.S. Cl.
CPC ..... *F04C 29/028* (2013.01); *F04C 18/0215* (2013.01); *F04C 23/008* (2013.01); *F04C 29/025* (2013.01)

(58) Field of Classification Search
CPC ..... F04C 2/025; F04C 18/0207–0292; F04C 15/0088; F04C 15/0092;
(Continued)

(56) References Cited

U.S. PATENT DOCUMENTS 4,332,535 A 6/1982 Terauchi et al.
4,565,503 A * 1/1986 Wise ..... H02K 9/19 417/372

(Continued)

FOREIGN PATENT DOCUMENTS

CN 111102160 A 5/2020
EP 1 413 758 A2 4/2004

(Continued)

OTHER PUBLICATIONS

English Translation of Chen et al. (CN 111102160 A), Published May 5, 2020. (Year: 2020).*

(Continued)

*Primary Examiner* — Laert Dounis
(74) *Attorney, Agent, or Firm* — McCormick, Paulding & Huber PLLC

(57) ABSTRACT

The scroll compressor (1) includes a compression unit (6); a drive shaft (16) which is vertically orientated; upper and lower bearing arrangements (27, 28) configured to rotatably support the drive shaft (16); a centrifugal oil pump (29) including a pick-up tube (32) attached to a lower end portion (23) of the drive shaft (16) and provided with a oil inlet immersed in an oil sump (31), the centrifugal oil pump (29) being configured to deliver oil to the compression unit (6) and to the upper and lower bearing arrangements (27, 28); and a static fairing member (35) secured to a non-rotating part of the scroll compressor (1) and including a static tubular part (36) which is immersed in the oil sump (31) and which surrounds the pick-up tube (32) with a predetermined distance such that a gap is formed between the inner surface of the static tubular part (36) and the outer surface of the pick-up tube (32).

17 Claims, 4 Drawing Sheets

(58) Field of Classification Search
CPC .. F04C 29/02–028; F01C 1/0207–0292; F01C 21/04; F01C 21/045
See application file for complete search history.

(56) References Cited

U.S. PATENT DOCUMENTS

| | | | | |
|---|---|---|---|---|
| 5,533,875 | A * | 7/1996 | Crum | F04C 29/023 418/94 |
| 6,171,090 | B1 * | 1/2001 | Hurley | F04B 39/0261 418/94 |
| 7,351,045 | B2 | 4/2008 | Sugimoto | |
| 2007/0065307 | A1 * | 3/2007 | Sugimoto | F04C 29/025 417/410.5 |
| 2012/0134859 | A1 | 5/2012 | Duppert | |
| 2015/0030487 | A1 * | 1/2015 | Toyama | F04C 18/02 418/55.1 |

FOREIGN PATENT DOCUMENTS

| | | | | |
|---|---|---|---|---|
| FR | 3031549 | A1 * | 7/2016 | F04C 18/0215 |
| JP | 52069614 | U * | 5/1977 | |
| JP | 56013570 | U * | 2/1981 | |
| JP | S56-13570 | U | 2/1981 | |
| JP | 57020585 | U * | 2/1982 | |
| JP | 58044488 | U * | 3/1983 | |
| JP | 59003182 | A * | 1/1984 | |
| JP | 60237182 | A * | 11/1985 | |
| JP | H05-65884 | A | 3/1993 | |
| JP | H09-32760 | A | 2/1997 | |
| JP | 2014118932 | A | 6/2014 | |

OTHER PUBLICATIONS

First Examination Report for Indian Patent Application No. 202214005672, dated Sep. 21, 2022.

* cited by examiner

SCROLL COMPRESSOR HAVING A CENTRIFUGAL OIL PUMP

CROSS-REFERENCE TO RELATED APPLICATION

This application claims foreign priority benefits under 35 U.S.C. § 119 to French Patent Application No. 2102350 filed on Mar. 10, 2021, the content of which is hereby incorporated by reference in its entirety.

TECHNICAL FIELD

The present invention relates to a scroll compressor, and in particular to a scroll refrigeration compressor.

BACKGROUND

As known, a scroll compressor comprises:

- a hermetic outer shell provided with a suction inlet intended to receive low pressure refrigerant gas from a component of a refrigerant cycle and a discharge outlet intended to deliver compressed refrigerant gas at high pressure to another component of the refrigerant cycle,
- a compression unit including at least a first scroll element and a second scroll element, the second scroll element being configured to perform an orbiting movement relative to the first scroll element during operation of the scroll compressor,
- a drive shaft which is vertically orientated and which is configured to cooperate with the second scroll element,
- an electric motor comprising a stator connected to the hermetic outer shell and a rotor secured to the drive shaft, the electric motor being configured to drive in rotation the drive shaft about a rotation axis,
- an upper bearing arrangement and a lower bearing arrangement configured to rotatably support the drive shaft within the hermetic outer shell, the upper and lower bearing arrangements being connected to the hermetic outer shell, and
- a centrifugal oil pump including a pick-up tube attached to a lower end portion of the drive shaft and provided with an oil inlet arranged at a lower end of the pick-up tube, the oil inlet being immersed in an oil sump arranged in a bottom section of the hermetic outer shell, the oil pump being configured to deliver, during operation of the scroll compressor, oil to the compression unit and to the upper and lower bearing arrangements through an oil supplying channel formed within the drive shaft and extending over at least a part of the length of the drive shaft.

Such a simple centrifugal oil pump is—due to its low manufacturing costs—widely used for fixed speed scroll compressors. For variable speed scroll compressors, such a centrifugal oil pump has to be modified to ensure sufficient oil supply over the entire operational speed range, e.g. at high operational speed.

U.S. Pat. No. 7,351,045 B2 discloses a scroll compressor comprising a pump arrangement provided with a centrifugal pick-up pump attached to the lower end of a drive shaft and with an oil cup attached to the bottom of a compressor outer shell. The sidewall of the oil cup surround the centrifugal pick-up pump and is provided with through holes which brought into communication the inside of the oil cup with an oil sump. To avoid excessive rotation of the oil inside the oil cup, blade elements are attached to the inner wall surface of the oil cup and extend radially towards the centrifugal pick-up pump.

JP 2014-118932 A discloses a scroll compressor with another shield for a centrifugal oil pump. Here, a cylindrical skirt member is attached to a lower bearing housing and surrounds the centrifugal oil pump with certain distance. The axial end of the cylindrical skirt member is arranged below the oil inlet of the centrifugal oil pump. A cup-shaped oil filter is attached to the cylindrical skirt member and surrounds the lower end and the oil inlet of the centrifugal oil pump.

Both solutions disclosed in U.S. Pat. No. 7,351,045 B2 and JP 2014-118932 A are somehow costly and do not fully prevent swirling or rotation of oil at the oil inlet of the pick-up oil pump, such that stable oil supply cannot be ensured at very high compressor speed.

SUMMARY

It is an object of the present invention to provide an improved scroll compressor which can overcome the drawbacks encountered in conventional scroll compressors.

Particularly, an object of the present invention is to provide a scroll compressor having a reliable low cost oil pump enabling stable oil supply to the upper and lower bearing arrangements and to the compression unit.

Another object of the present invention is to provide a scroll compressor which has improved efficiency and lifetime compared to the conventional scroll compressors.

According to the invention such a scroll compressor includes:

- a hermetic outer shell provided with a suction inlet configured to supply the scroll compressor with refrigerant gas to be compressed and a discharge outlet configured to discharge compressed refrigerant gas,
- a compression unit including at least a first scroll element and a second scroll element, the second scroll element being configured to perform an orbiting movement relative to the first scroll element during operation of the scroll compressor,
- a drive shaft which is vertically orientated and which is configured to cooperate with the second scroll element,
- an upper bearing arrangement and a lower bearing arrangement configured to rotatably support the drive shaft within the hermetic outer shell,
- a centrifugal oil pump including a pick-up tube attached to a lower end portion of the drive shaft and provided with a oil inlet arranged at a lower end of the pick-up tube, the oil inlet being immersed in an oil sump arranged in a bottom section of the hermetic outer shell, the centrifugal oil pump being configured to deliver, during operation of the scroll compressor, oil to the compression unit and to the upper and lower bearing arrangements, wherein the scroll compressor further includes a static fairing member secured to a non-rotating part of the scroll compressor, the static fairing member including a static tubular part which is at least partially immersed in the oil sump and which surrounds the pick-up tube with a predetermined distance such that a gap is formed between the inner surface of the static tubular part and the outer surface of the pick-up tube, the minimal radial distance between the inner surface of the static tubular part and the outer surface of the pick-up tube is between 0.5 and 5 mm, and advantageously around 2 mm.

The specific configuration of the static tubular part, and particularly the fact that the static tubular part and the pick-up tube are separated by a small predetermined distance, avoids—or at least minimizes—rotation, swirling or turbulences in the oil at the oil inlet of the pick-up tube, as there is considerably less surface area of the rotating pick-up tube exposed to the oil sump volume.

Particularly, the specific configuration of the static tubular part allows minimizing, especially at high compressor speed, the agitation of the lubricant oil within the oil sump, and thus substantially reduces forming of bubbles or even foaming of the lubricant oil contained in the oil sump. Therefore, the amount of oil entering the centrifugal oil pump is increased and the amount of oil delivered to the various surfaces of the compressor to be lubricated and/or sealed is also increased compared to conventional scroll compressors. This results to lower frictions in the various surfaces of the compressor to be lubricated, and thus to an improved efficiency and an improved lifetime of the compressor while using reliable low cost oil pump.

In addition, by minimizing oil agitation at the upper free surface of the oil sump, which is in contact with the suction flow of refrigerant gas, an undesired increased oil circulation rate within the refrigeration system may be avoided.

The scroll compressor may also include one or more of the following features, taken alone or in combination.

According to an embodiment of the invention, the static tubular part shields an immersed wall part of pick-up tube, which is immersed in the oil sump, from the oil contained in the oil sump, except the immersed wall part area adjacent to the oil inlet.

According to an embodiment of the invention, the static tubular part shields an immersed wall part of pick-up tube, which is immersed in the oil sump, from the oil contained in the oil sump.

According to an embodiment of the invention, the static tubular part surrounds the lower end of the pick-up tube, and thus extends over the lower end of the pick-up tube.

According to an embodiment of the invention, the static fairing member is arranged coaxially with the pick-up tube.

According to an embodiment of the invention, the gap formed between the inner surface of the static tubular part and the outer surface of the pick-up tube is annular.

According to an embodiment of the invention, the width of the gap is selected such that negligible frictional forces are created between the inner surface of the static tubular part and the outer surface of the pick-up tube, and such that a creation of an oil-free area at the oil inlet of the pick-up tube is avoided.

According to an embodiment of the invention, the static tubular part includes a lower tubular portion which surrounds a lower tube part of the pick-up tube, for example with a constant gap.

According to an embodiment of the invention, the inner surface of the static tubular part and the outer surface of the pick-up tube are configured such that the width of the gap formed between the outer surface of the pick-up tube and the inner surface of the static tubular part is substantially uniform along the longitudinal axis of the pick-up tube and/or along the outer circumference of the pick-up tube.

According to an embodiment of the invention, the inner surface of the static tubular part is substantially complementary to the outer surface of the pick-up tube.

According to an embodiment of the invention, the static tubular part axially protrudes from the lower end of the pick-up tube. In other terms, the lower end of the static tubular part is located below the lower end of the pick-up tube.

According to an embodiment of the invention, the axial distance between the lower end of the static tubular part and the lower end of the pick-up tube is between 1 and 3 mm, and advantageously around 2 mm.

According to an embodiment of the invention, the axial distance between the lower end of the static tubular part and the lower end of the pick-up tube is greater than the minimal radial distance between the inner surface of the static tubular part and the outer surface of the pick-up tube.

According to an embodiment of the invention, the inner surface of the static tubular part directly faces the outer surface of the pick-up tube. In other terms, no other structural part of the scroll compressor is located between the inner surface of the static tubular and the outer surface of the pick-up tube.

According to an embodiment of the invention, the static tubular part includes an inlet opening arranged at the lower end of the static tubular part and facing the oil inlet of the pick-up tube.

According to an embodiment of the invention, the flow cross-section area of the inlet opening of the static tubular part substantially corresponds to or is greater than the flow cross-section area of the oil inlet of the pick-up tube.

According to an embodiment of the invention, the static fairing member comprises inlet guide vanes radially extending from the outer surface of the static tubular part.

According to an embodiment of the invention, the static fairing member is arranged coaxially with the radial bearing housing.

According to an embodiment of the invention, the pick-up tube is attached, e.g. by press-fitting, in an axial recess formed at the lower axial end of the drive shaft.

According to an embodiment of the invention, the static tubular part is cylindrical and has an inner diameter which is substantially uniform along the longitudinal axis of the static tubular part.

According to an embodiment of the invention, the static tubular part includes an upper tubular portion which is cylindrical and a lower tubular portion which converges towards the lower end of the static tubular part.

According to an embodiment of the invention, the centrifugal oil pump is configured to deliver, during operation of the scroll compressor, oil to the compression unit and to the upper bearing arrangement through an oil supplying channel formed within the drive shaft and extending over at least a part of the length of the drive shaft.

According to an embodiment of the invention, the lower bearing arrangement comprises a radial bearing housing configured to rotatably support the lower end portion of the drive shaft, the radial bearing housing including an inner radial bearing surface surrounding the outer surface of the lower end portion of the drive shaft.

According to an embodiment of the invention, the static fairing member is secured to the radial bearing housing.

According to an embodiment of the invention, the lower bearing arrangement further comprises upper and lower axial thrust bearings configured to limit an axial movement of the drive shaft during operation, and a pressurized oil chamber which is fluidly connected to the centrifugal oil pump, the pressurized oil chamber being at least partially delimited by the outer surface of the lower end portion of the drive shaft, the inner radial bearing surface and the upper and lower axial thrust bearings.

According to an embodiment of the invention, the pressurized oil chamber is delimited in an axial direction respectively by the upper and lower axial thrust bearings.

According to an embodiment of the invention, the lower end portion of the drive shaft includes a radial opening fluidly connected to an oil outlet of the centrifugal oil pump, the radial opening facing the radial bearing housing and emerging in the pressurized oil chamber.

According to an embodiment of the invention, the scroll compressor is a variable speed scroll compressor or a fixed speed scroll compressor.

According to an embodiment of the invention, the scroll compressor is an electric motor comprising a stator connected to the hermetic outer shell and a rotor secured to the drive shaft, the electric motor being configured to drive in rotation the drive shaft about a rotation axis.

According to an embodiment of the invention, a radial clearance ratio, which is the ratio between the minimal radial distance and the outer diameter of the pick-up tube is between 2 and 25%, preferably between 5 and 15%.

According to an embodiment of the invention, the width of the gap is substantially uniform along the longitudinal axis of the upper tube part of the pick-up tube and along the outer circumference of the upper tube part of the pick-up tube, and increases along the longitudinal axis of the lower tube part of the pick-up tube and towards the lower end of the pick-up tube.

BRIEF DESCRIPTION OF THE DRAWINGS

The following detailed description of several embodiments of the invention is better understood when read in conjunction with the appended drawings being understood, however, that the invention is not limited to the specific embodiments disclosed.

DETAILED DESCRIPTION

Figure 1:
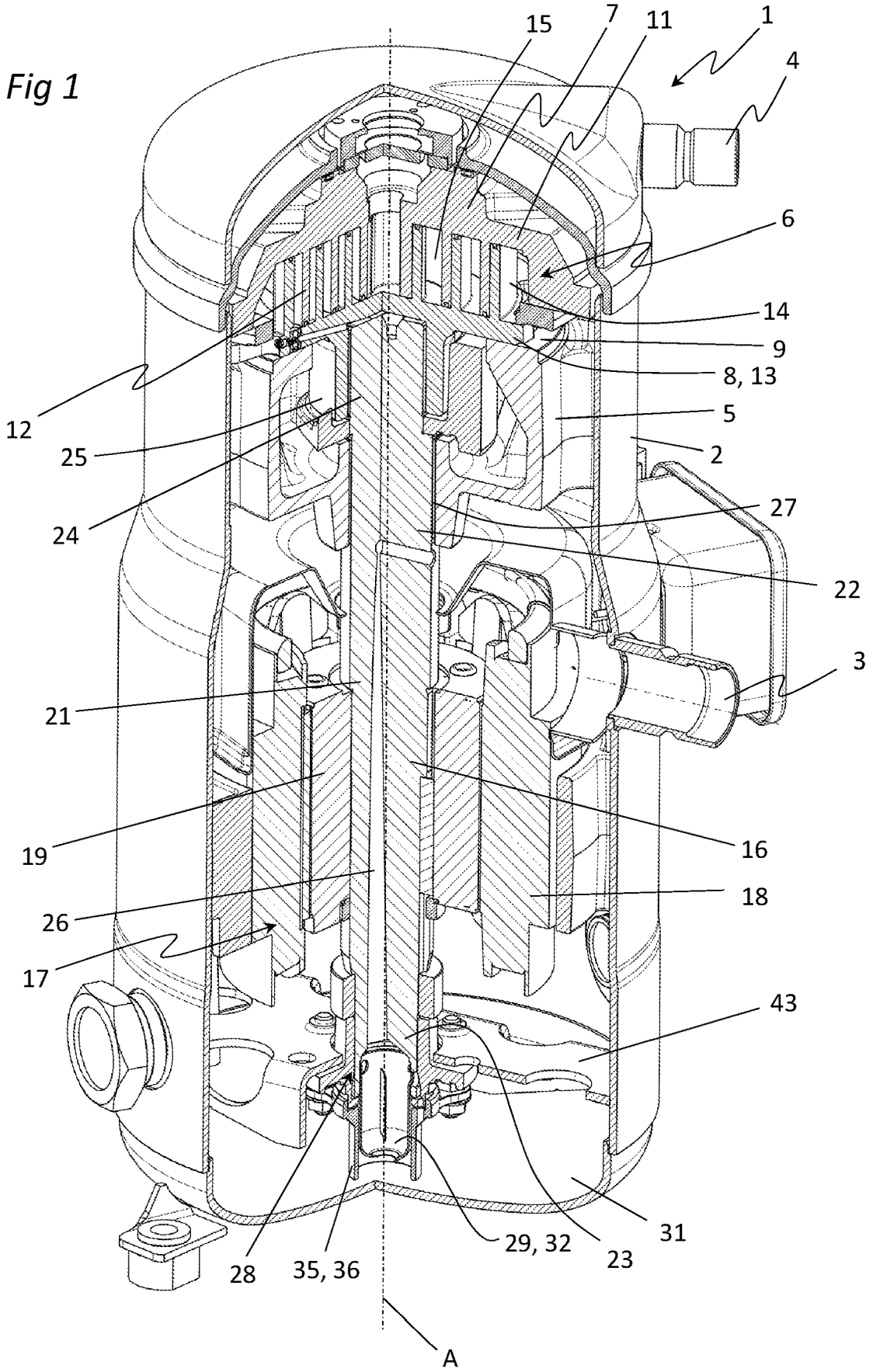
FIG. 1 is a perspective view, partially truncated, of a scroll compressor according to a first embodiment of the invention.

FIG. 1 describes a scroll compressor 1 according to a first embodiment of the invention.

The scroll compressor 1 includes a hermetic outer shell 2 provided with a suction inlet 3 configured to supply the scroll compressor 1 with refrigerant gas to be compressed, and with a discharge outlet 4 configured to discharge compressed refrigerant gas. Particularly, the suction inlet 3 is intended to receive low pressure refrigerant gas from a component of a refrigerant cycle and the discharge outlet 4 is intended to deliver compressed refrigerant gas at high pressure to another component of the refrigerant cycle.

The scroll compressor 1 further includes a support arrangement 5 fixed to the hermetic outer shell 2, and a compression unit 6 disposed inside the hermetic outer shell 2 and supported by the support arrangement 5. The compression unit 6 is configured to compress the refrigerant gas supplied by the suction inlet 3.

According to the embodiment shown on the figures, the compression unit 6 includes a first scroll element 7, which is fixed in relation to the hermetic outer shell 2, and a second scroll element 8 which is supported by and in slidable contact with an upper thrust bearing surface 9 provided on the support arrangement 5. The second scroll element 8 is configured to perform an orbiting movement relative to the first scroll element 7 during operation of the scroll compressor 1.

The first scroll element 7 includes a fixed base plate 11 having a lower face oriented towards the second scroll element 8, and an upper face opposite to the lower face of the fixed base plate 11. The first scroll element 7 also includes a fixed spiral wrap 12 projecting from the lower face of the fixed base plate 11 towards the second scroll element 8.

The second scroll element 8 includes an orbiting base plate 13 having an upper face oriented towards the first scroll element 7, and a lower face opposite to the upper face of the orbiting base plate 13 and slidably mounted on the upper thrust bearing surface 9. The second scroll element 8 also includes an orbiting spiral wrap 14 projecting from the upper face of the orbiting base plate 13 towards the first scroll element 7. The orbiting spiral wrap 14 of the second scroll element 8 meshes with the fixed spiral wrap 12 of the first scroll element 7 to form a plurality of compression chambers 15 between them. Each of the compression chambers 15 has a variable volume which decreases from the outside towards the inside, when the second scroll element 8 is driven to orbit relative to the first scroll element 7.

Furthermore, the scroll compressor 1 includes a drive shaft 16 which is vertically orientated and which is configured to drive the second scroll element 8 in an orbital movement, and an electric motor 17, which may be for example a variable-speed electric motor, coupled to the drive shaft 16 and configured to drive in rotation the drive shaft 16 about a rotation axis A. The electric motor 17 comprises particularly a stator 18 connected to the hermetic outer shell 2 and a rotor 19 secured to the drive shaft 16.

The drive shaft 16 includes a longitudinal main part 21 including an upper end portion 22 and a lower end portion 23. The drive shaft 16 further includes a driving portion 24 which is provided at an upper end of the longitudinal main part 21 and which is offset from the longitudinal axis of the drive shaft 16. The driving portion 24 is partially mounted in a hub portion 25 provided on the second scroll element 8, and is configured to cooperate with the hub portion 25 so as to drive the second scroll element 8 in orbital movements relative to the first scroll element 7 when the electric motor 17 is operated.

The drive shaft 16 also includes an oil supplying channel 26 formed within the drive shaft 16 and extending over at least a part of the length of the drive shaft 16. According to the embodiment shown on the figures, the oil supplying channel 26 extends along the entire length of the drive shaft 16 and emerge in an upper axial end surface of the drive shaft 16.

The scroll compressor 1 further includes an upper bearing arrangement 27 and a lower bearing arrangement 28 which are connected to the hermetic outer shell 2 and which are configured to rotatably support respectively the upper end portion 22 of the longitudinal main part 21 and the lower end portion 23 of the longitudinal main part 21.

The scroll compressor 1 also includes a centrifugal oil pump 29 arranged at a lower end of the drive shaft 16 and partially immersed in an oil sump 31 arranged in a bottom section of the hermetic outer shell 2. The centrifugal oil pump 29 is configured to deliver, during operation of the scroll compressor 1, oil, from the oil sump 31, to the compression unit 6 and to the upper and lower bearing arrangements 27, 28. The centrifugal oil pump 29 is particularly configured to deliver, during operation of the scroll compressor 1, oil to the compression unit 6 and to the upper bearing arrangement 27 through the oil supplying channel 26 formed within the drive shaft 16.

The centrifugal oil pump 29 includes a pick-up tube 32 attached, e.g. by press-fitting, in an axial recess 33 formed at the lower axial end of the drive shaft 16. The pick-up tube 32 includes an oil inlet 34 arranged at a lower end of the pick-up tube 32 and being immersed the oil sump 31. According to the embodiment shown on FIGS. 1 to 3, the pick-up tube 32 includes an upper tube part 32.1 which is cylindrical and a lower tube part 32.2 which extends coaxially with the upper tube part 32.1 and which converges towards the lower end of the pick-up tube 32.

The scroll compressor 1 further includes a static fairing member 35 secured to a non-rotating part of the scroll compressor 1 and arranged coaxially with the pick-up tube 32. The static fairing member 35 includes a static tubular part 36 which is partially immersed in the oil sump 31. According to the embodiment shown on FIGS. 1 to 3, the static tubular part 36 is cylindrical and has an inner diameter which is substantially uniform along the longitudinal axis of the static tubular part 36.

The static tubular part 36 surrounds the pick-up tube 32 with a predetermined distance such that a gap 37, which is annular, is formed between the inner surface of the static tubular part 36 and the outer surface of the pick-up tube 32. The static tubular part 36 particularly surrounds the lower end of the pick-up tube 32, and thus the oil inlet 34.

The width of the gap 37 is selected such that negligible frictional forces are created between the inner surface of the static tubular part 36 and the outer surface of the pick-up tube 32, and such that a creation of an oil-free area at the oil inlet 34 of the pick-up tube 32 is avoided. Particularly, the minimal radial distance Dr between the inner surface of the static tubular part 36 and the outer surface of the pick-up tube 32 is between 0.5 and 5 mm, and advantageously around 2 mm.

According to an embodiment of the invention, a radial clearance ratio, which is the ratio between the minimal radial distance Dr and the outer diameter of the pick-up tube 32 is between 2 and 25%, preferably between 5 and 15%.

Figure 2:
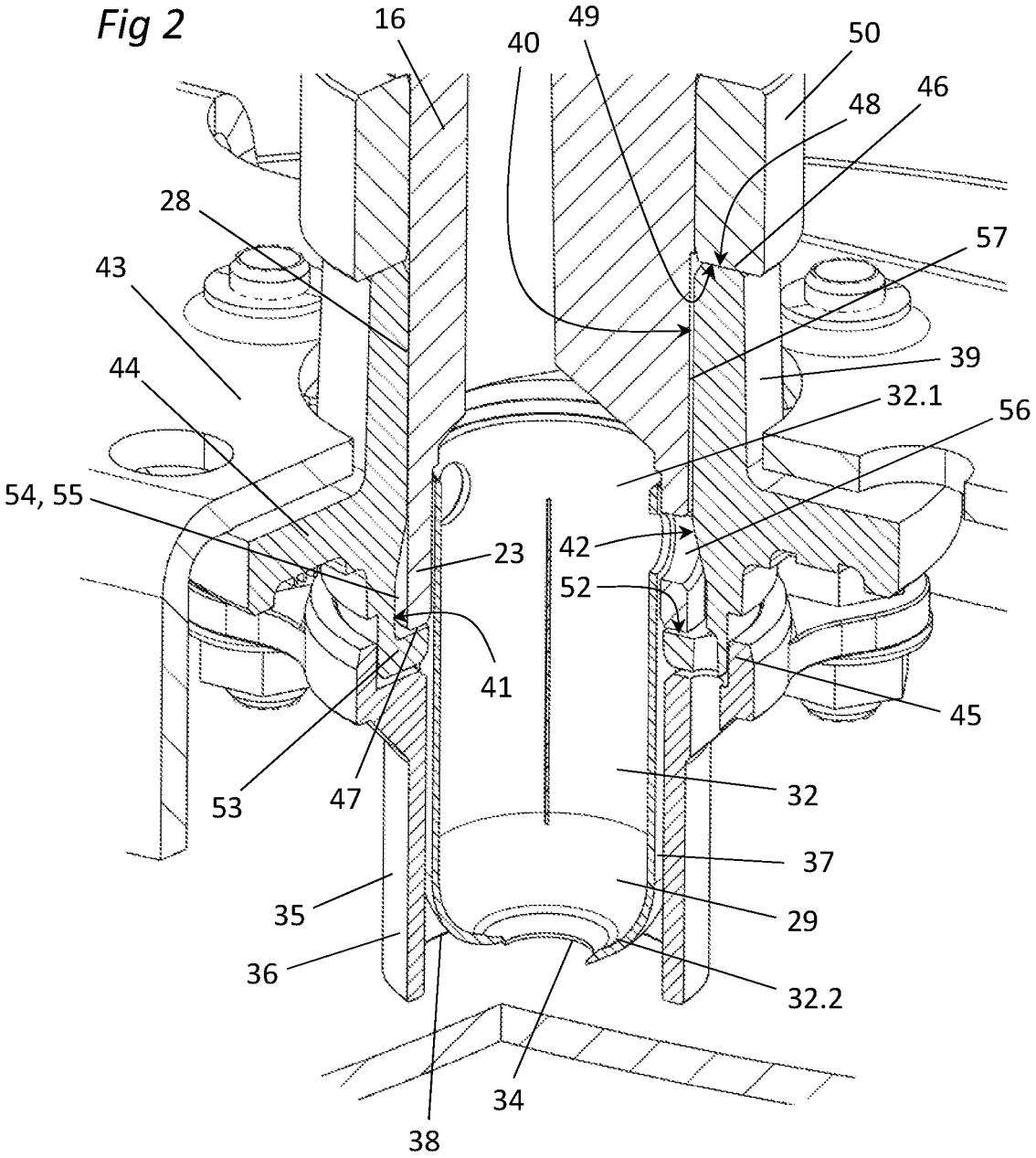
FIG. 2 is an enlarged view of a detail of FIG. 1.
Figure 3:
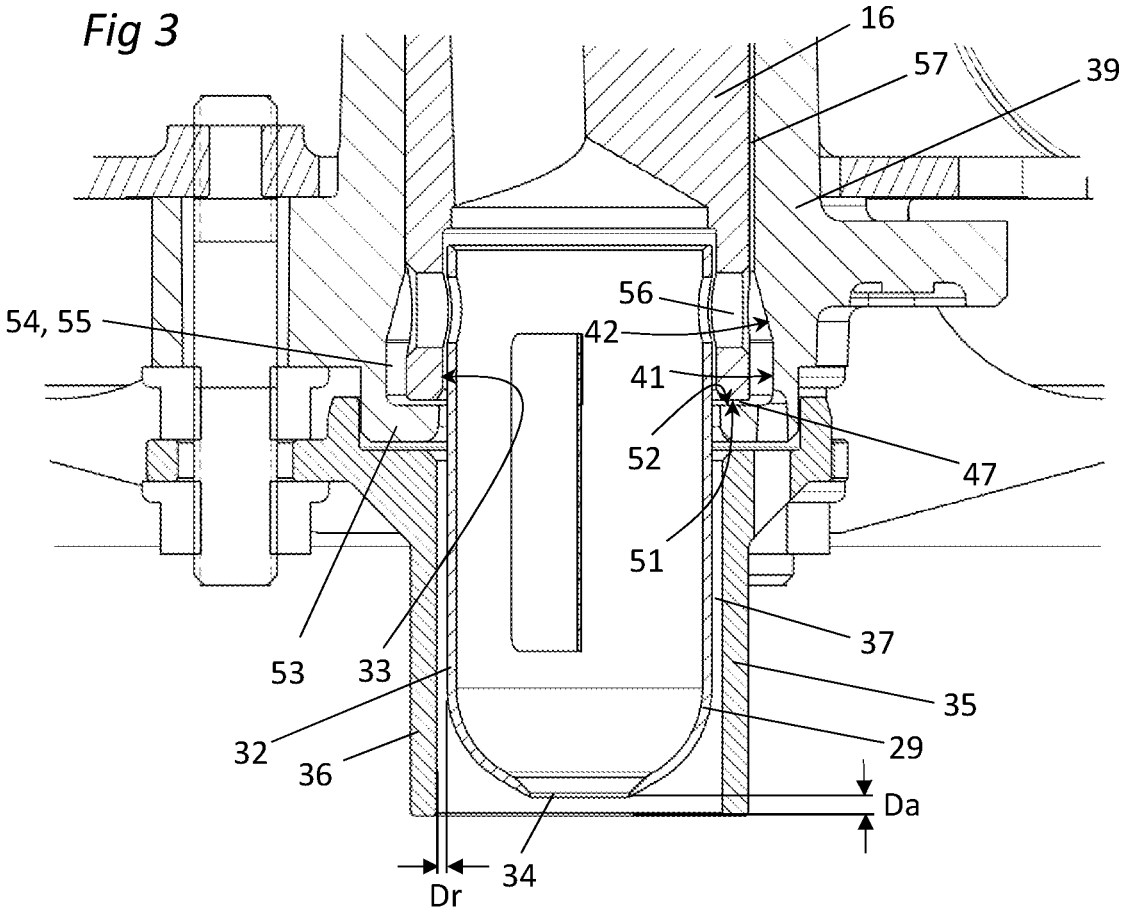
FIG. 3 is partial longitudinal cross-section view of the scroll compressor of FIG. 1.

According to the embodiment shown on FIGS. 1 to 3, the width of the gap 37 is substantially uniform along the longitudinal axis of the upper tube part 32.1 of the pick-up tube 32 and along the outer circumference of the upper tube part 32.1 of the pick-up tube 32, and increases along the longitudinal axis of the lower tube part 32.2 of the pick-up tube 32 and towards the lower end of the pick-up tube 32.

The static tubular part 36 includes an inlet opening 38 which is arranged at the lower end of the static tubular part 36 and which faces the oil inlet 34 of the pick-up tube 32. According to the embodiment shown on FIGS. 1 to 3, the inlet opening 38 and the oil inlet 34 each have a circular shape, and the flow cross-section area of the inlet opening 38 of the static tubular part 36 is greater than the flow cross-section area of the oil inlet 34 of the pick-up tube 32.

As better shown on FIG. 3, the static tubular part 36 axially protrudes from the lower end of the pick-up tube 32. In other terms, the lower end of the static tubular part 36 is located below the lower end of the pick-up tube 32. The axial distance Da between the lower end of the static tubular part 36 and the lower end of the pick-up tube 32 is between 1 and 3 mm, and advantageously around 2 mm. Particularly, the axial distance Da between the lower end of the static tubular part 36 and the lower end of the pick-up tube 32 is greater than the minimal radial distance Dr between the inner surface of the static tubular part 36 and the outer surface of the pick-up tube 32.

The provision of the static fairing member 35, and particularly the configuration of the static tubular part 36, avoids—or at least minimizes—rotation, swirling or turbulences in the oil at the oil inlet 34 of the pick-up tube 32, as there is considerably less surface area of the rotating pick-up tube 12 exposed to the oil sump volume.

Further, the configuration of the static tubular part 36 allows minimizing, especially at high compressor speed, the agitation of the lubricant oil within the oil sump, and thus substantially reduces forming of bubbles or even foaming of the lubricant oil contained in the oil sump 31. This results to lower frictions in the various thrust and radial bearing surfaces supplied with oil by the centrifugal oil pump 29, an improved efficiency and an improved lifetime of the compressor.

In addition, by minimizing oil agitation at the upper free surface of the oil sump, which is in contact with the suction flow of refrigerant gas, an undesired increased oil circulation rate within the refrigeration system may be avoided.

As better shown on FIG. 2, the lower bearing arrangement 28 comprises a radial bearing housing 39 configured to rotatably support the lower end portion 23 of the drive shaft 16. The radial bearing housing 39 surrounds the lower end portion 23 of the drive shaft 16 and is arranged coaxially with the drive shaft 16. Advantageously, the radial bearing housing 39 has a globally tubular shape and is formed by a radial bearing sleeve.

According to the embodiment shown on the figures, the radial bearing housing 39 includes an inner radial bearing surface 40 which is cylindrical and which surrounds the outer surface of the lower end portion 23 of the drive shaft 16. The inner radial bearing surface 40 has a first inner diameter. The radial bearing housing 39 also includes an inner circumferential surface 41 having a second inner diameter which is greater than the first inner diameter. Advantageously, the radial bearing housing 39 further includes an inner frustoconical surface 42 located between the inner radial bearing surface 40 and the inner circumferential surface 41 and diverging towards the inner circumferential surface 41.

The lower bearing arrangement 28 further comprises a bracket member 43 secured to an inner surface of the hermetic outer shell 2, and the radial bearing housing 39 includes a mounting part 44 having a ring shape and being secured to the bracket member 43 for example by use of screws or bolts. Advantageously, the static fairing member 35 is arranged coaxially with the radial bearing housing 39 and below the radial bearing housing 39, and is secured to the mounting part 44 of the radial bearing housing 39.

The static fairing member 35 may include a centering rib 45 which is annular and which is configured to cooperate with the radial bearing housing 39 to center the static fairing member 35 with respect to the longitudinal axis of the radial bearing housing 39.

Furthermore, the lower bearing arrangement 28 comprises upper and lower axial thrust bearings 46, 47 configured to limit an axial movement of the drive shaft 16 during operation. According to the embodiment shown on the figures, the upper axial thrust bearing 46 is formed by an upper axial end surface 48 of the radial bearing housing 39 and by a shoulder surface 49 secured to the drive shaft 16.

The shoulder surface 49 may be formed integral with the drive shaft 16 or may be formed by a separate ring-shaped part 50 secured to the drive shaft 16. Advantageously, the upper axial end surface 48 and the shoulder surface 49 are each annular.

According to the embodiment shown on the figures, the lower axial thrust bearing 47 is formed by a lower axial end surface 51 of the drive shaft 16 and by an internal bottom surface 52 of the radial bearing housing 39. Advantageously, the lower axial end surface 51 and the internal bottom surface 52 are each annular, and the radial bearing housing 39 includes a radially inwardly projecting annular flange 53 which includes the internal bottom surface 52.

The lower bearing arrangement 28 also comprises a pressurized oil chamber 54 which is fluidly connected to the centrifugal oil pump 29. The pressurized oil chamber 54 is delimited by the outer surface of the lower end portion 23 of the drive shaft 16, the inner radial bearing surface 40, the inner circumferential surface 41 and the upper and lower axial thrust bearings 46, 47. Advantageously, the pressurized oil chamber 54 is delimited in an axial direction respectively by the upper and lower axial thrust bearings 46, 47.

As better shown on FIG. 2, the pressurized oil chamber 54 includes an annular pressurized oil volume 55 which surrounds the lower end portion 23 of the drive shaft 16 and which is externally delimited by the radial bearing housing 39, and particularly by the inner circumferential surface 41 and the inner frustoconical surface 42. Advantageously, the annular pressurized oil volume 55 is located below the inner radial bearing surface 40, and is adjacent to the internal bottom surface 52.

According to the embodiment shown on the figures, the lower end portion 23 of the drive shaft 16 includes at least one radial opening 56 fluidly connected to an oil outlet of the centrifugal oil pump 29. Advantageously, the radial opening 56 faces the inner surface of the radial bearing housing 39 and emerges in the pressurized oil chamber 54 and particularly in the annular pressurized oil volume 55. Advantageously, the oil outlet of the centrifugal oil pump 29, which is fluidly connected to the radial opening 56, extends radially and is provided on a sidewall of the pick-up tube 32.

The pressurized oil chamber 54 further comprises an oil passage 57 formed between the outer surface of lower end portion 23 of the drive shaft 16 and the inner surface of the radial bearing housing 39. Advantageously, the oil passage 57 extends along an extension direction which is substantially parallel to the longitudinal axis of the drive shaft 16. The oil passage 57 is particularly configured to fluidly connect the upper axial thrust bearing 46 with the annular pressurized oil volume 55 of the pressurized oil chamber 54.

The oil passage 57 may be formed as a flat surface portion provided on the outer circumference of the lower end portion 23 of the drive shaft 16.

Figure 4:
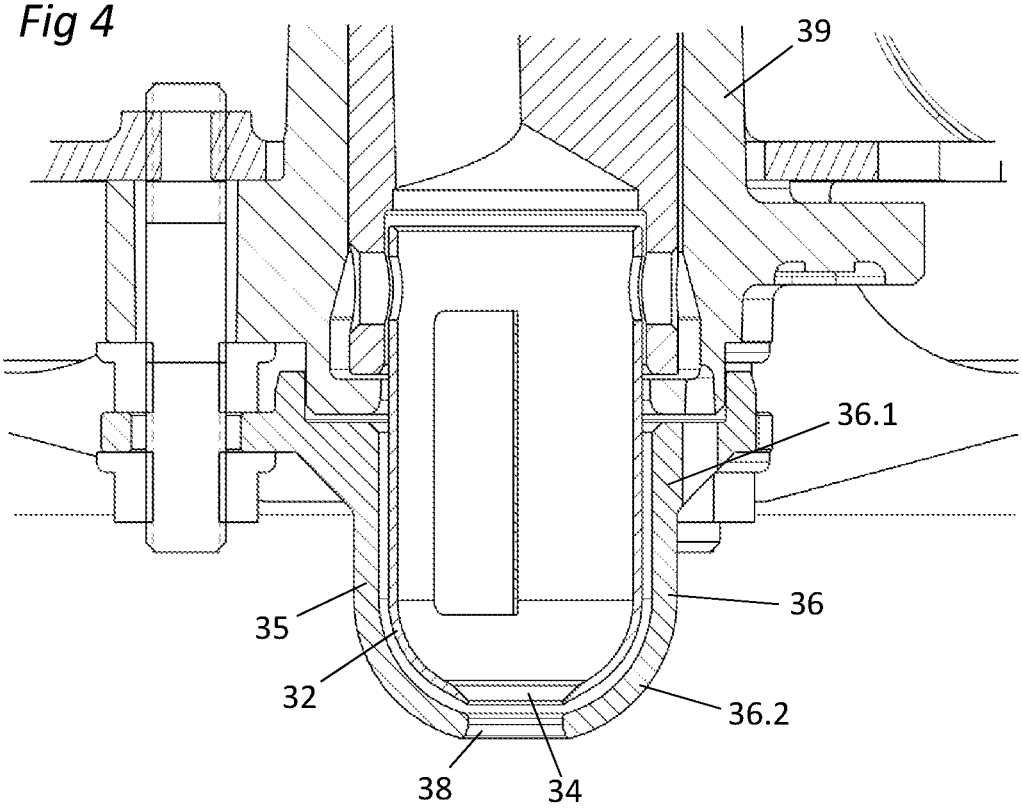
FIG. 4 is partial longitudinal cross-section view of a scroll compressor according to second first embodiment of the invention.

At high rotational speed of the rotor 19 and the drive shaft 16, the oil delivered by the oil outlet of the centrifugal oil pump 29 is high and thus high oil centrifugal speed occurs at the radial opening 56 of the drive shaft 16, leading to a significant hydrodynamic pressure in the pressurized oil chamber 54. As the pressurized oil chamber 54 is closed by the upper and lower axial thrust bearings 46, 47, a hydrostatic force is created, which may be in the same magnitude as the gravitational force derived from the mass of the drive shaft 16. This improves the lubrication of the upper and lower axial thrust bearings 46, 47 and thus further improves compressor efficiency due to reduced frictional losses. Further, wear of the thrust bearing surfaces of the upper and lower axial thrust bearings 46, 47, and particularly of the lower axial thrust bearing 47, is reduced, which further improves the lifetime of the scroll compressor 1.

a. FIG. 4 represents a scroll compressor 1 according to a second embodiment of the invention which differs from the first embodiment shown on FIGS. 1 to 3 essentially in that the inner surface of the static tubular part 36 is substantially complementary to the outer surface of the pick-up tube 32 such that the width of the gap 37 formed between the outer surface of the pick-up tube 32 and the inner surface of the static tubular part 36 is substantially uniform along the longitudinal axis of the pick-up tube 32 and along the outer circumference of the pick-up tube 32. Particularly, the static tubular part 36 includes an upper tubular portion 36.1 which is cylindrical and a lower tubular portion 36.2 which extends coaxially with the upper tubular portion 36.1 and which converges towards the lower end of the static tubular part 36. The upper tubular portion 36.1 surrounds the upper tube part 32.1 while the lower tubular portion 36.2 surrounds the lower tube part 32.2.

According to the second embodiment of the invention, the flow cross-section area of the inlet opening 38 of the static tubular part 36 substantially corresponds to the flow cross-section area of the oil inlet 34 of the pick-up tube 32.

Figure 5:
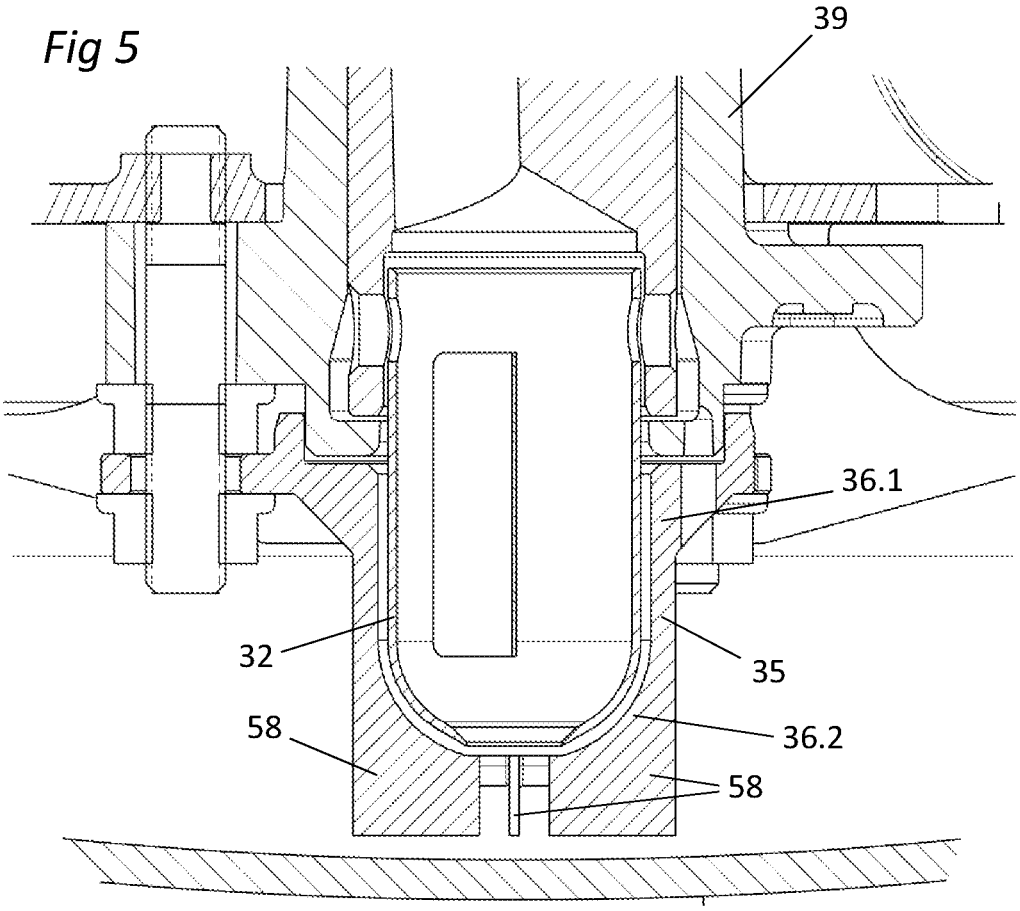
FIG. 5 is partial longitudinal cross-section view of a scroll compressor according to third first embodiment of the invention.

FIG. 5 represents a scroll compressor 1 according to a third embodiment of the invention which differs from the second embodiment shown on FIG. 4 essentially in that the static fairing member 35 comprises inlet guide vanes 58 radially extending from the outer surface of the static tubular part 36. Advantageously, the inlet guide vanes 58 are regularly distributed around the longitudinal axis of the static fairing member 35.

The inlet guide vanes 58 may for example includes a first set of inlet guide vanes 58 having a first axial length and a second set of inlet guide vanes 58 having a second axial length such that the lower ends of the inlet guide vanes 58 of the second set extend below the lower ends of the inlet guide vanes 58 of the first set. However, the lower ends of all the inlet guide vanes 58 may extend in a same plane.

Of course, the invention is not restricted to the embodiments described above by way of non-limiting examples, but on the contrary it encompasses all embodiments thereof.

What is claimed is:

1. A scroll compressor including:

a hermetic outer shell provided with a suction inlet configured to supply the scroll compressor with refrigerant gas to be compressed and a discharge outlet configured to discharge compressed refrigerant gas, a compression unit including at least a first scroll element and a second scroll element, the second scroll element being configured to perform an orbiting movement relative to the first scroll element during operation of the scroll compressor, a drive shaft which is vertically orientated and which is configured to cooperate with the second scroll element, an upper bearing arrangement and a lower bearing arrangement configured to rotatably support the drive shaft within the hermetic outer shell, a centrifugal oil pump including a pick-up tube attached to a lower end portion of the drive shaft and provided with an oil inlet arranged at a lower end of the pick-up tube, the oil inlet being immersed in an oil sump arranged in a bottom section of the hermetic outer shell, the centrifugal oil pump being configured to deliver, during operation of the scroll compressor, oil to the compression unit and to the upper and lower bearing arrangements, wherein the scroll compressor further includes a static fairing member secured to a non-rotating part of the scroll compressor, the static fairing member including a static tubular part which is at least partially immersed in the oil sump and which surrounds the pick-up tube with a predetermined distance such that a gap is formed between the inner surface of the static tubular part and the outer surface of the pick-up tube, a minimal radial distance (Dr) between the inner surface of the static tubular part and the outer surface of the pick-up tube is between 0.5 and 5 mm, wherein the lower bearing arrangement comprises a radial bearing housing configured to rotatably support the lower end portion of the drive shaft, the radial bearing housing including an inner radial bearing surface surrounding the outer surface of the lower end portion of the drive shaft, wherein the lower bearing arrangement further comprises upper and lower axial thrust bearings configured to limit an axial movement of the drive shaft during operation, and a pressurized oil chamber which is fluidly connected to the centrifugal oil pump, the pressurized oil chamber being at least partially delimited by the outer surface of the lower end portion of the drive shaft, the inner radial bearing surface and the upper and lower axial thrust bearings, wherein the inner radial bearing surface has a first inner diameter and the radial bearing housing further includes an inner circumferential surface having a second inner diameter which is greater than the first inner diameter, wherein the radial bearing housing further includes an inner frustoconical surface located between the inner radial bearing surface and the inner circumferential surface and diverging towards the inner circumferential surface, and wherein a radial opening of the drive shaft faces the frustoconical surface.

2. The scroll compressor according to claim 1, wherein the gap formed between the inner surface of the static tubular part and the outer surface of the pick-up tube is annular.

3. The scroll compressor according to claim 1, wherein the static tubular part includes a lower tubular portion which surrounds a lower tube part of the pick-up tube, with a constant gap.

4. The scroll compressor according to claim 1, wherein the inner surface of the static tubular part and the outer surface of the pick-up tube are configured such that the width of the gap formed between the outer surface of the pick-up tube and the inner surface of the static tubular part is substantially uniform along the longitudinal axis of the pick-up tube and/or along the outer circumference of the pick-up tube.

5. The scroll compressor according to claim 1, wherein the static tubular part axially protrudes from the lower end of the pick-up tube.

6. The scroll compressor according to claim 1, wherein an axial distance (Da) between the lower end of the static tubular part and the lower end of the pick-up tube is between 1 and 3 mm.

7. The scroll compressor according to claim 1, wherein an axial distance (Da) between the lower end of the static tubular part and the lower end of the pick-up tube is greater than the minimal radial distance (Dr) between the inner surface of the static tubular part and the outer surface of the pick-up tube.

8. The scroll compressor according to claim 1, wherein a radial clearance ratio, which is the ratio between the minimal radial distance (Dr) and the outer diameter of the pick-up tube is between 2 and 25%.

9. The scroll compressor according claim 1, wherein the inner surface of the static tubular part directly faces the outer surface of the pick-up tube.

10. The scroll compressor according to claim 1, wherein the static tubular part includes an inlet opening arranged at the lower end of the static tubular part and facing the oil inlet of the pick-up tube.

11. The scroll compressor according to claim 10, wherein the flow cross-section area of the inlet opening of the static tubular part substantially corresponds to or is greater than the flow cross-section area of the oil inlet of the pick-up tube.

12. The scroll compressor according to claim 1, wherein the static fairing member comprises inlet guide vanes radially extending from the outer surface of the static tubular part.

13. The scroll compressor according to claim 1, wherein the static fairing member is secured to the radial bearing housing.

14. The scroll compressor according to claim 2, wherein the inner surface of the static tubular part and the outer surface of the pick-up tube are configured such that the width of the gap formed between the outer surface of the pick-up tube and the inner surface of the static tubular part is substantially uniform along the longitudinal axis of the pick-up tube and/or along the outer circumference of the pick-up tube.

15. The scroll compressor according to claim 3, wherein the inner surface of the static tubular part and the outer surface of the pick-up tube are configured such that the width of the gap formed between the outer surface of the pick-up tube and the inner surface of the static tubular part is substantially uniform along the longitudinal axis of the pick-up tube and/or along the outer circumference of the pick-up tube.

16. The scroll compressor according to claim 1, wherein the static tubular part includes an upper tubular portion which is cylindrical and a lower tubular portion which converges towards the lower end of the static tubular part.

17. The scroll compressor according to claim 1, wherein the lower axial thrust bearing is formed by a lower axial end surface of the driveshaft and by an internal bottom surface of the radial bearing housing, wherein the lower axial end surface and the internal bottom surface are each annular, and the radial bearing housing includes a radially inwardly projecting annular flange which includes the internal bottom surface.

* * * * *